United States Patent [19]

Iijima

[11] Patent Number: 5,048,416

[45] Date of Patent: Sep. 17, 1991

[54] MULTI-COLOR PRINTING APPARATUS

[75] Inventor: Yutaka Iijima, Komae, Japan

[73] Assignee: Duplo Corporation, Komae, Japan

[21] Appl. No.: 554,414

[22] Filed: Jul. 19, 1990

[30] Foreign Application Priority Data

Jul. 24, 1989 [JP] Japan ..... 1-191156

[51] Int. Cl.[5] ..... B41F 15/10; B41L 13/08

[52] U.S. Cl. ..... 101/115; 101/122

[58] Field of Search ..... 101/114, 115, 117, 118, 101/121, 122, 128.4, 129, 116, 119, 120

[56] References Cited

U.S. PATENT DOCUMENTS 4,134,338 1/1979 Selman ..... 101/122

4,628,813 12/1986 Hasegawa ..... 101/116

*Primary Examiner*—J. Reed Fisher

*Attorney, Agent, or Firm*—Oblon, Spivak, McClelland, Maier & Neustadt

[57] ABSTRACT

In each of the pressure transferring sections of the printing device, a pair of cylinders, a screen positioned to pass over the cylinders and an inking device for supplying ink to the original printing stencil on the screen are arranged. An original printing stencil supplying device and a used printing stencil collecting device are moved as an integral unit to the first pressure transferring section by means of a moving device. Then, the used printing stencil on the screen is collected by the used printing stencil collecting device and a new engraved original printing stencil is supplied from the original printing stencil supplying device and mounted on the screen. Ink for the first color is supplied to the original printing stencil by means of the inking device. Then, the original printing stencil supplying device and used printing stencil collecting device are moved to the second pressure transferring section, and the process is repeated. In this way, the original printing stencils having different images for respective colors are mounted on all the pressure transferring sections, and one sheet of printing paper is passed through the pressure transferring sections so that the images of the respective colors are printed on the printing paper.

9 Claims, 4 Drawing Sheets

MULTI-COLOR PRINTING APPARATUS

BACKGROUND OF THE INVENTION

This invention relates to a multi-color printing apparatus to produce multi-color printing by the stencil printing technique while the printing paper makes one pass through the apparatus. It uses image transferring sections provided for the respective colors to transfer color images onto the printing paper and selectively moves the stencil supplying/discharging means which includes an original printing stencil supplying device and a used printing stencil collecting device.

A conventional, multi-color printing apparatus for printing multiple color images onto a single sheet of paper is constructed with printing sections of the stencil rotary press arranged in a tandem configuration. In this type of multi-color printing apparatus, the original printing stencils having the different images for the respective colors are created by the original printing stencil creating device which is arranged separately from the printing apparatus and the respective original printing stencils are manually mounted on the printing drums of the respective printing sections.

If images printed in different printing cycles are deviated from one another, the image will be printed as multiple or overlapping images. In order to prevent deviation in the printing position, the feeding operations of the printing paper feeding mechanisms are synchronized with one another.

Further, the above printing deviation is caused not only by the printing paper feeding mechanism but it can also be caused when the original printing stencils are created or they are mounted on the printing section. Therefore, after the original printing stencils are mounted on the printing drum, a trial printing is conducted to check whether there is a printing deviation or not. If there is a printing deviation, the mounting position of the original printing stencil is corrected to eliminate it.

The printing stencil (called a used printing stencil) is left on the screen after the printing operation is completed to prevent ink on the screen from drying, and is removed when a new original printing stencil is mounted.

As described above, the original printing stencils for respective colors are created by different devices, and after the original printing stencils are manually mounted on the printing drum, a trial printing is conducted to check for printing deviation. Thus, the operation is complex and takes a long time. Further, since it is impossible to adjust the mounting position of the original printing stencil precisely to the preset position, it is difficult to perform a high quality printing operation without causing printing deviation.

In addition, there is the possibility that a new original printing stencil will be stained when the used printing stencil is removed or the new original printing stencil is mounted.

SUMMARY OF THE INVENTION

The purpose of this invention is to provide a multi-color printing apparatus in which the operation of creating an original printing stencil, mounting the original printing stencil and removing a used printing stencil is accomplished by a common device for each color; and the operation is automatically accomplished so as to prevent diminished printing quality due to printing deviation, stain of the original printing stencil is prevented and a smooth, clean operation is attained.

The multi-color printing apparatus in this invention includes:

- a plurality of pressure transferring means provided for respective colors to press printing paper against an original printing stencil to transfer the image thereto;
- printing paper supplying means for passing printing paper through the plurality of pressure transferring means;
- an original printing stencil supplying device having a stencil supplying section for supplying stencil paper, a thermal head for engraving an image on the stencil paper and a cutter for cutting the engraved stencil paper at preset lengths to provide original printing stencils, the original printing stencil supplying device supplying the original printing stencil to the pressure transferring means;
- a used printing stencil collecting device for collecting used printing stencils discharged from the pressure transferring means; and
- moving means for moving the original printing stencil supplying device and used printing stencil collecting device as an integral unit between the pressure transferring means, to selectively set the original printing stencil supplying device and used printing stencil collecting device to the position of one of the pressure transferring means.

In this invention, the moving means moves the original printing stencil supplying device and used printing stencil collecting device to the position of the first pressure transferring means. Then, the printing stencil used in the preceding printing cycle is collected by the used printing stencil collecting device. After this, the original printing stencil supplying device takes a stencil paper from the stencil supplying section, and the thermal head forms a preset image for the first color on the stencil paper upon receiving a signal from the image signal outputting device, thus providing an original printing stencil for the first color. Then the original printing stencil supplying device supplies the original printing stencil for the first color to the first pressure transferring means and mounts the stencil on it.

After this, the moving means moves the original printing stencil supplying device and used printing stencil collecting device to the position of the second pressure transferring means. The procedure described for the first pressure transferring means is repeated to produce the second color printing stencil which is mounted in the same manner as the first.

The operation as described above is repeated to mount original printing stencils of images for respective colors on the plurality of pressure transferring means. The printing paper supplying means supplies a sheet of printing paper to the pressure transferring means so that the images on the original printing stencils, mounted on the pressure transferring means, can be printed on one sheet of paper. In this way, the multi-color printing operation for one sheet of printing paper is completed. After this, the printing paper supplying means successively supplies a preset number of sheets of printing paper to the pressure transferring means to produce the multi-color printed paper. The multi- color printing operation for the image is then completed.

After the above printing operation is completed, the moving means again moves the original printing stencil supplying device and used printing stencil collecting device to the position of the first pressure transferring means. And, the next printing cycle is started.

As described above, the original printing stencils to be mounted on a plurality of pressure transferring means are produced by the common original printing stencil supplying device and each original printing stencil is mounted on a corresponding pressure transferring means from the common original printing stencil supplying device which is moved and positioned by the moving means. As a result, the respective original printing stencils can be mounted on the corresponding pressure transferring means in alignment with one another. Therefore, the possibility that the original printing stencils can be placed in the preset positions is extremely high. With this invention, unlike other machines the troublesome operation caused by manually mounting multiple original printing stencils on the respective pressure transferring means and positioning them by the method of trial and error can be eliminated. Further, since it is not necessary to touch the used printing stencil, there is no chance of staining the fingers with ink. Therefore, the operation can always be accomplished smoothly and cleanly.

PREFERRED EMBODIMENT

Figure 1:
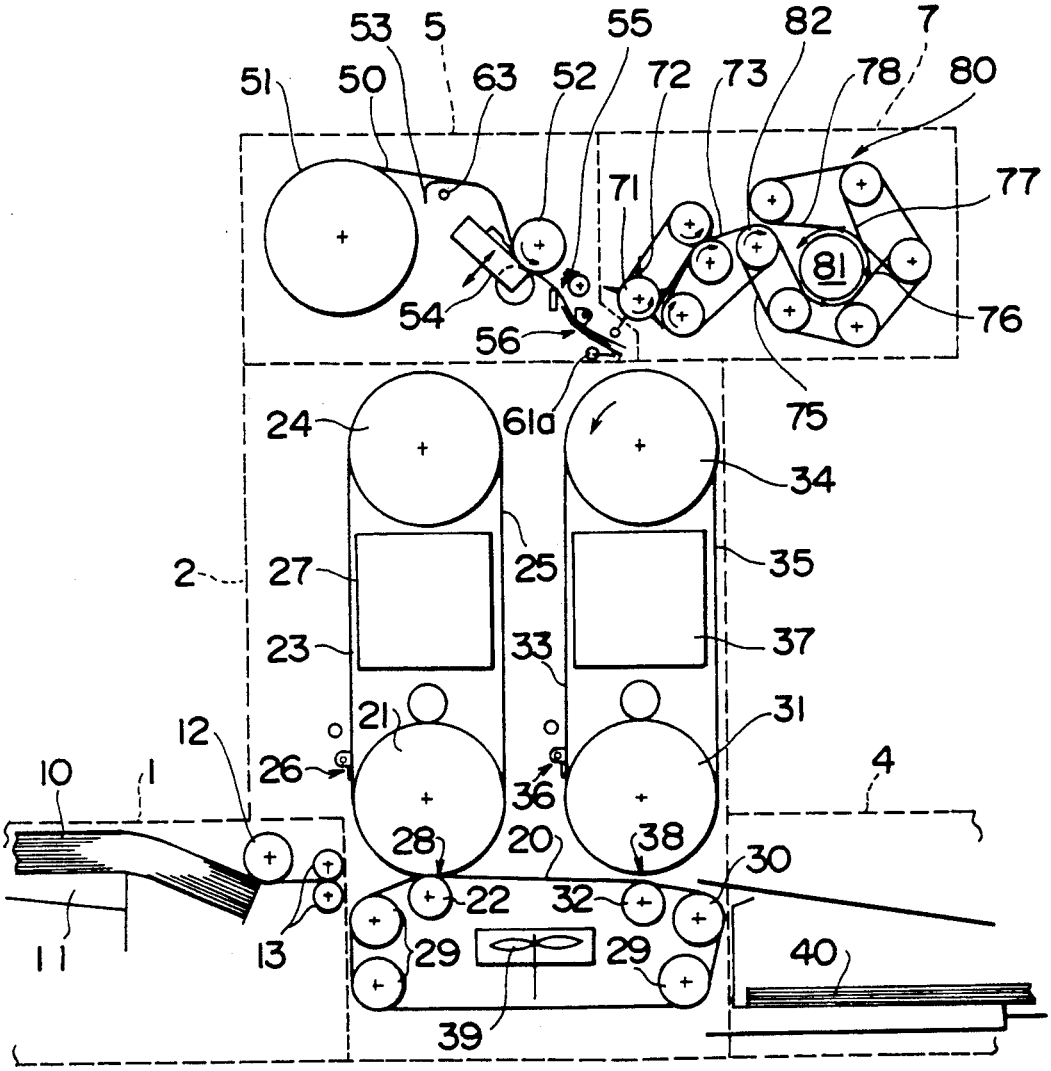
FIG. 1 is a schematic diagram showing the entire portion of a multi-color printing device.

As shown in FIG. 1, paper supplying device 1 and paper discharging device 4 are arranged with printing device 2 positioned between them, printing paper 10 is supplied from paper supplying device 1 to printing device 2 and the printed paper is collected by paper discharging device 4.

In paper supplying device 1, paper 10 is stacked on printing paper reception plate 11, and printing paper 10 is taken out one sheet at a time by paper supplying roller 12 positioned in front of reception plate 11. Printing paper 10 is fed into printing device 2 by a pair of timing rollers 13.

In printing device 2, pressure rollers 22 and 32 are respectively positioned on the upstream side and downstream side of printing paper flow route with the axis set horizontally. Two idling rollers 29 are positioned near pressure roller 22 and driving roller 30 and idling roller 29 are positioned near pressure roller 32 with the axis set horizontally. Flat loop belt 20 is stretched over pressure rollers 22 and 32, idling rollers 29 and driving roller 30. Driving roller 30 is rotated by a driving device (not shown), and consequently, pressure rollers 22 and 32 and idling rollers 29 are driven by flat loop belt 20 which moves in the upper range in a direction from paper supplying device 1 towards paper discharging device 3. The flat loop belt 20 is in a mesh form to allow air to flow through. Suction fan 39 is positioned in an area directly below that portion of flat loop belt 20 which lies between pressure rollers 22 and 32. Printing paper 10 on flat loop belt 20 is drawn by suction fan 39 via flat loop belt 20 and adheres to flat loop belt 20 by suction force. As a result, deviation in the position of the to-be-transferred image can be avoided.

Cylinders 21 and 31 are positioned directly above pressure rollers 22 and 32 and are driven, together with pressure rollers 22 and 32. Cylinders 24 and 34 are positioned directly above cylinders 21 and 31, respectively, with the axis set horizontally and in parallel with the axis of cylinders 21 and 31. Loop screens 25 and 35 are stretched over paired cylinders 21 and 24, and 31 and 34. Cylinders 21 and 31 are driven by a driving device (not shown), and cylinders 24 and 34 are driven via gear connecting device (not shown). Clamps 26 and 36 are positioned on screens 25 and 35, and the front ends of original printing stencils 23 and 33 are clamped by means of clamps 26 and 36 so that original printing stencils 23 and 33 can be mounted on screens 25 and 35.

Inking mechanisms 27 and 37 are positioned in areas surrounded by screens 25 and 35, so as to supply ink to original printing stencils 23 and 33 via screens 25 and 35. Inking mechanisms 27 and 37 supply inks of respective colors to be used for printing.

In case printing paper 10 is not fed to pressure applying points 28 and 38 between pressure rollers 22 and 32 and cylinders 21 and 31, pressure rollers 22 and 32 are separated from cylinders 21 and 31 by means of a normal cam link mechanism (not shown). As a result, ink covering original printing stencils 23 and 33 is prevented from being transferred to flat loop belt 20. In case clamps 26 and 36 of screens 25 and 35 pass pressure applying points 28 and 38, pressure rollers 22 and 32 are separated from cylinders 21 and 31 so as to permit them to freely pass.

The pairs of cylinders 21 and 24 and 31 and 34 are synchronously driven by means of a gear or timing belt. The position of cylinders 31 and 34 lying on the downstream side with respect to the flow route of printing paper 10 can be adjusted to some extent in the flow direction of printing paper 10 so as to permit the position of the images to be adjusted in the flow direction.

With printing device 2 thus constructed, the image of one of the two colors is printed on printing paper 10 fed by flat loop belt 20 at rolling point 28 between cylinder 21 and pressure roller 22, and then the image of the other color is printed at rolling point 38 between cylinder 31 and pressure roller 32.

Printing paper 10 on which the two-color printing operation is made by printing device 2 is discharged towards the printing paper reception plate 40 of the paper discharging device 4.

Figure 2:
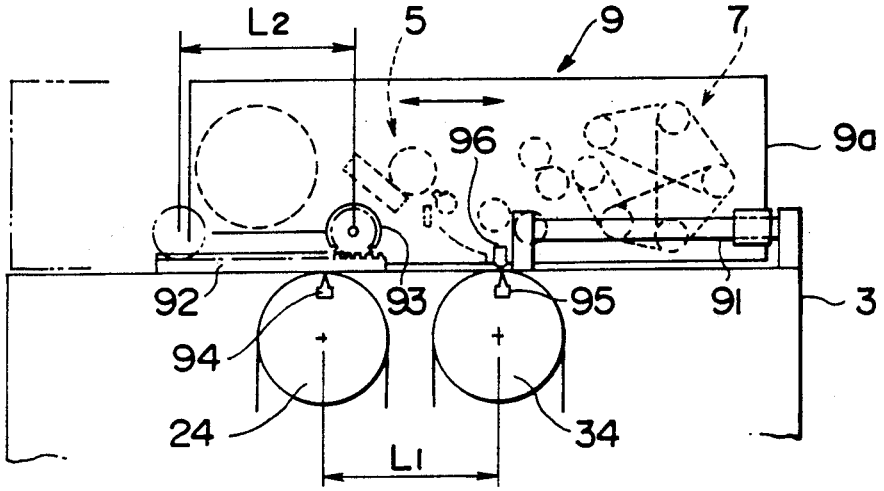
FIG. 2 is a schematic diagram showing the moving device for moving the original printing stencil supplying device and the used printing stencil collecting device.

Original printing stencil supplying device 5 and used printing stencil collecting device 7 are positioned on the upper side of printing device 2. As shown in FIG. 2, the original printing stencil supplying device 5 and used printing stencil collecting device 7 are positioned in housing **9*a* of moving device 9, and are moved together with housing 9*a* of moving device 9. In moving device 9, guide 91 is mounted on frame 3 of printing device 2. Housing 9*a*, original printing stencil supplying device 5 and used printing stencil collecting device 7 are guided by guide 91 and smoothly move in a horizontal plane parallel to a plane including the axis of cylinders 24 and 34** in a direction perpendicular to the axis thereof.

In moving device 9, rack 92 is positioned in parallel with guide 91 and pinion 93 is positioned in housing 9a so as to be engaged with rack 92. Pinion 93 is rotated by a motor (not shown) positioned in housing 9a so as to move on rack 92. In this case, the driving mechanism of moving device 9 is constructed so that pinion 93 may run on rack 92 mounted on the frame 3, or may be constructed in reverse in which rack 92 is fixed on housing 9a, pinion 93 is mounted on frame 3, and housing 9a is moved by rotating pinion 93. In addition, it is possible to utilize various known techniques using a mechanism having a timing belt or a chain and a sprocket.

Sensor 96 is positioned on moving device 9. Indicators 94 and 95 to be detected by sensor 96 are positioned in appropriate positions of printing device 2. The original position of printing stencil supplying device 5 is set in the same position as or extremely near the discharge position of used printing stencil collecting device 7. Sensor 96 and indicators 94 and 95 are set in such positions that sensor 96 can detect indicators 94 and 95 when the original printing stencil supplying position and the used printing stencil discharging position are set directly above cylinders 24 and 34 respectively. Moving device 9 moves in response to a signal from the control device (FIG. 8) and stops when sensor 96 detects one of the indicators 94 and 95. Therefore, traveling distance $L_2$ of moving device 9 is set to be equal to distance $L_1$ between the axis of cylinders 24 and 34. The positions of indicators 94 and 95 can be adjusted by means of a semi-fixed type fine adjustment device. With this device, printing deviation in the traveling direction can be corrected.

Figure 3:
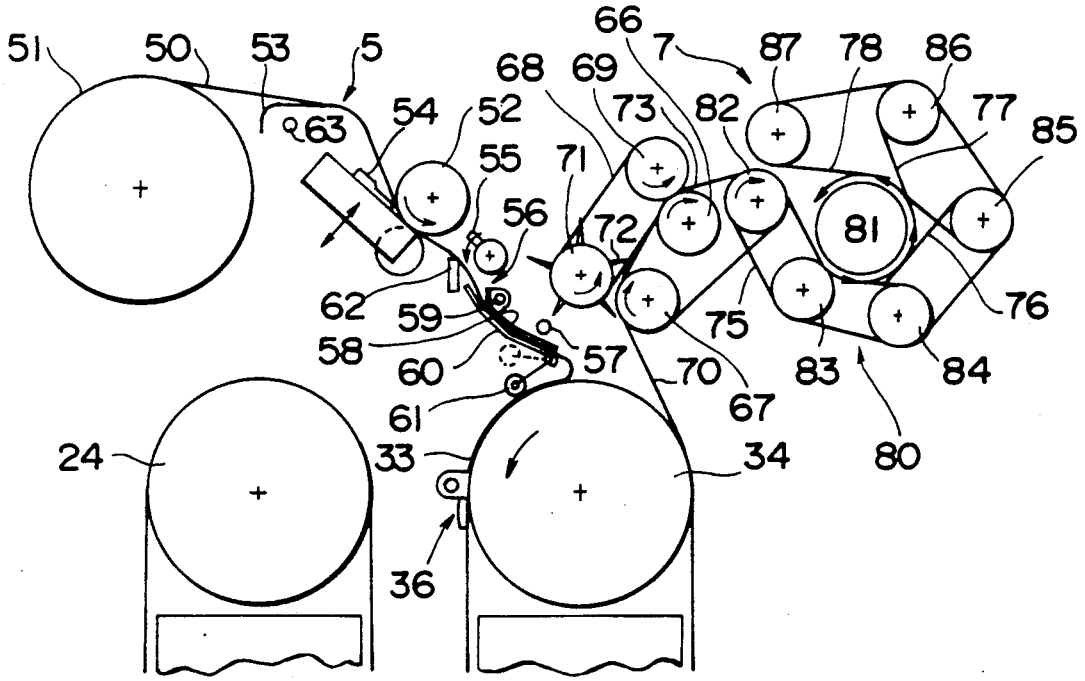
FIG. 3 is a schematic diagram showing the original printing stencil supplying device and used printing stencil collecting device.
Figure 4:
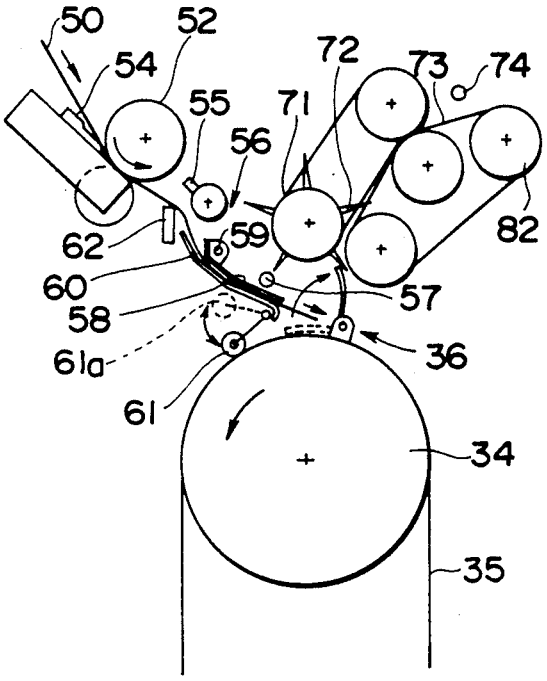
FIGS. 4 through 7 are schematic diagrams showing the operation of the original printing stencil supplying device and a used printing stencil collecting device.
Figure 5:
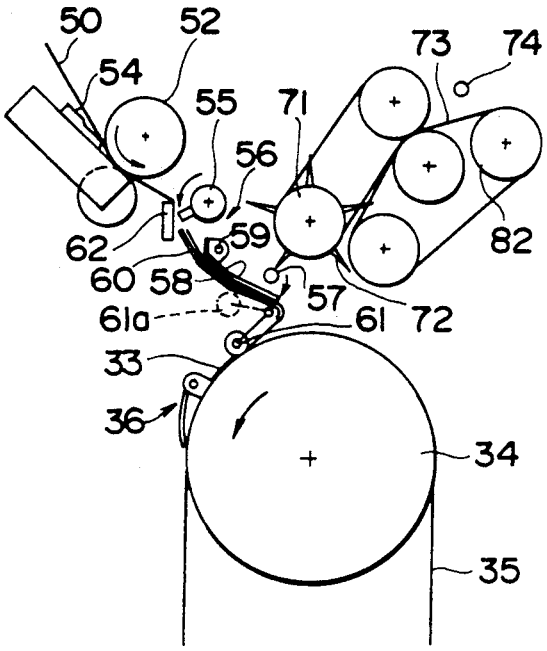

As shown in FIG. 3, original printing stencil supplying device 5 supplies an original printing stencil to printing device 2. In original printing stencil supplying device 5, roll master 51 and platen 52 are arranged with the axis thereof set parallel to the axis of cylinders 24 and 34.

Stencil paper 50 is stocked in rolled form on roll master 51. Platen 52 is rotated in synchronism with a signal supplied from a document image reading device or word processor (not shown) and also functions as a feeding roll for stencil paper 50. The feed amount of stencil paper 50 is controlled according to the number of rotations of platen 52.

Guide 53 for guiding stencil paper 50 supplied from roll master 51 to platen 52 is positioned between roll master 51 and platen 52. Further, sensor 63 is positioned near the rear end of guide 53, and when the end of stencil paper 50, unrolled from roll master 51 has passed guide 53, sensor 63 detects this and outputs a signal to an alarm device which in turn generates an alarm. As a result, interruption of the supply of the stencil paper can be prevented when the printing stencil is only half way imaged.

Guide 56 is positioned between the original printing stencil outlet of the original printing stencil supplying device 5 and platen 52. Thermal head 54 is positioned so that it can be brought into contact with platen 52 while pressing platen 52 with an adequate elastic force. Thermal head 54 is separated from platen 52 when the front end of stencil paper 50 passes platen 52. When an original printing stencil supplying signal is input from control device 100 mentioned earlier, thermal head 54 advances to hold stencil paper 50 between it and platen 52, makes an alignment marking and then waits. Next, thermal head 54 is driven together with the rotation of platen 52 in response to an original printing stencil forming signal so as to write image information from the document image reading device or word processor onto stencil paper 50. In this way, stencil paper 50 is fed in a forward direction by means of platen 52 while information is being written onto the stencil paper by means of thermal head 54.

Rotary cutter 55 and a fixed blade are positioned between platen 52 and guide 56. Rotary cutter 55 is driven via a one-cycle clutch, and when rotary cutter 55 rotates by one revolution, stencil paper 50 is cut off by fixed blade 62 and rotary cutter 55 to provide an original printing stencil of a preset size. Sensor 57 is positioned at the front end of guide 56 to detect the front edge of stencil paper 50. When platen 52 rotates by a preset number of revolutions after sensor 57 has detected the front edge of stencil paper 50, stencil paper 50 advances by a predetermined distance and the front edge thereof is inserted at a preset distance into clamp 26 or 36 which is set in an open state.

At this time, clamp 26 or 36 sets the clamping element into a closed state to hold the front edge of stencil paper 50 and cylinder 24 or 34 starts to rotate. In guide 56, fixed plate 60 for defining the movement path of stencil paper 50 and a rotary plate 58 having a substantially the same shape as fixed plate 60 and superposed thereon are positioned, the rear end of rotary plate 58 can slightly rotate with a supporting point as its axis. After rotary cutter 55 rotates to cut off stencil paper 50, rotary plate 58 rotates so that the front end thereof may approach fixed plate 60 to hold cut-off stencil paper 50 between it and fixed plate 60 with a slight force. At this time, platen 52 stops the feeding operation.

Roller 61 positioned on the front end of guide 56 can be moved back and forth between a position in which it is rotated with cylinder 24 or 34 as shown by a solid line in FIG. 3; and a position in which it is separated from cylinder 24 or 34 as shown by a broken line. When roller 61 is rotated by cylinder 24 or 34, original printing stencil 33 supplied onto the surface of cylinder 24 or 34 and whose front end is held by clamp 26 or 36 is stretched on the surface of cylinder 24 or 34 without causing crumple.

Next, used printing sheet collecting device 7 is explained. Used printing stencil collecting device 7 is positioned to face original printing stencil supplying device 5 with the original printing stencil supplying position for printing device 2 set between. Discharging roller 71 is positioned directly above the original printing stencil supplying position with the axial direction thereof set parallel to the axial direction of cylinders 24 and 34. A plurality of blades 72 made of silicone rubber and having adequate resilience are arranged on discharging roller 71. When discharging roller 71 rotates, blades 72 pick up used printing stencil 70. Discharging roller 71 and roller 69 positioned above discharging roller 71 are coupled by belt 68 which permits rollers 71 and 69 to be rotated at the same speed. Rollers 66 and 67 are positioned so that roller 66 can be rolled on roller 69 and other roller 67 may be positioned slightly away from discharging roller 71.

Take-up core 81 for taking up used printing stencil 70 is positioned slightly away from discharging roller 71 with the axial direction thereof set parallel to the axial directions of cylinders 24 and 34. Six rollers 82, 83, 84, 85, 86 and 87 are arranged around take-up core 81. Take-up core 81 and rollers 82 through 87 are combined to constitute a receiving device 80 for used printing stencils 70.

Discharging belt 73 is stretched over rollers 66, 67 and 82 to surround the rollers 66, 67 and 82. Belt 75 is stretched over rollers 82, 83 and 84, belt 76 is stretched over rollers 83, 84 and 85, belt 77 is stretched over rollers 84, 85 and 86, and belt 78 is stretched over rollers 85, 86 and 87. Each of the rollers rotates so that each of belts can rotate along the periphery of the take-up core 81 in a direction indicated by arrows in FIG. 3. In this case, belts 75, 76, 77 and 78 are made to have adequate resilience and are rotated along the periphery of take-up core 81. The belts press take-up core 81 with adequate force created by expansion or compression of the resilient material.

In used printing stencil collecting device 7 when two-color printing operation is completed, cylinder 24 or 34 is rotated to set clamp 26 or 36 of screen 25 or 35 at the highest position. Then, the clamping element of clamp 26 or 36 is set into the open position to lift the front end of used printing stencil 70 and resilient blades 72 of silicone rubber positioned on discharging roller 71 pick up used printing stencil 70. Used printing stencil 70 is carried upwards while being held between conveyer belt 73 and belt 68, and is then received into used printing stencil receiving device 80. The front end of used printing sheet 70 carried to roller 82 by conveyer belt 73, is moved to belt 75 along a guide (not shown) and is further transferred by means of belts 75, 76, 77 and 78 and wound around take-up core 81. Take-up core 81 takes up used printing sheet 70 by rotation of rollers 82 through 87. The core takes up succeeding used printing stencils 70 on top of the used printing stencils 70 previously taken up.

Each roller is driven to rotate each of belts 75, 76, 77 and 78 at the same speed, and belts 75, 76, 77 and 78 form the periphery of take-up core 81, whose outer diameter expands as the number of used printing stencils 70 taken up increases, at points where the tension of belts 75, 76, 77 and 78 are set in equilibrium.

Next, the control system for the above devices is explained with reference to FIG. 8.

Figure 8:
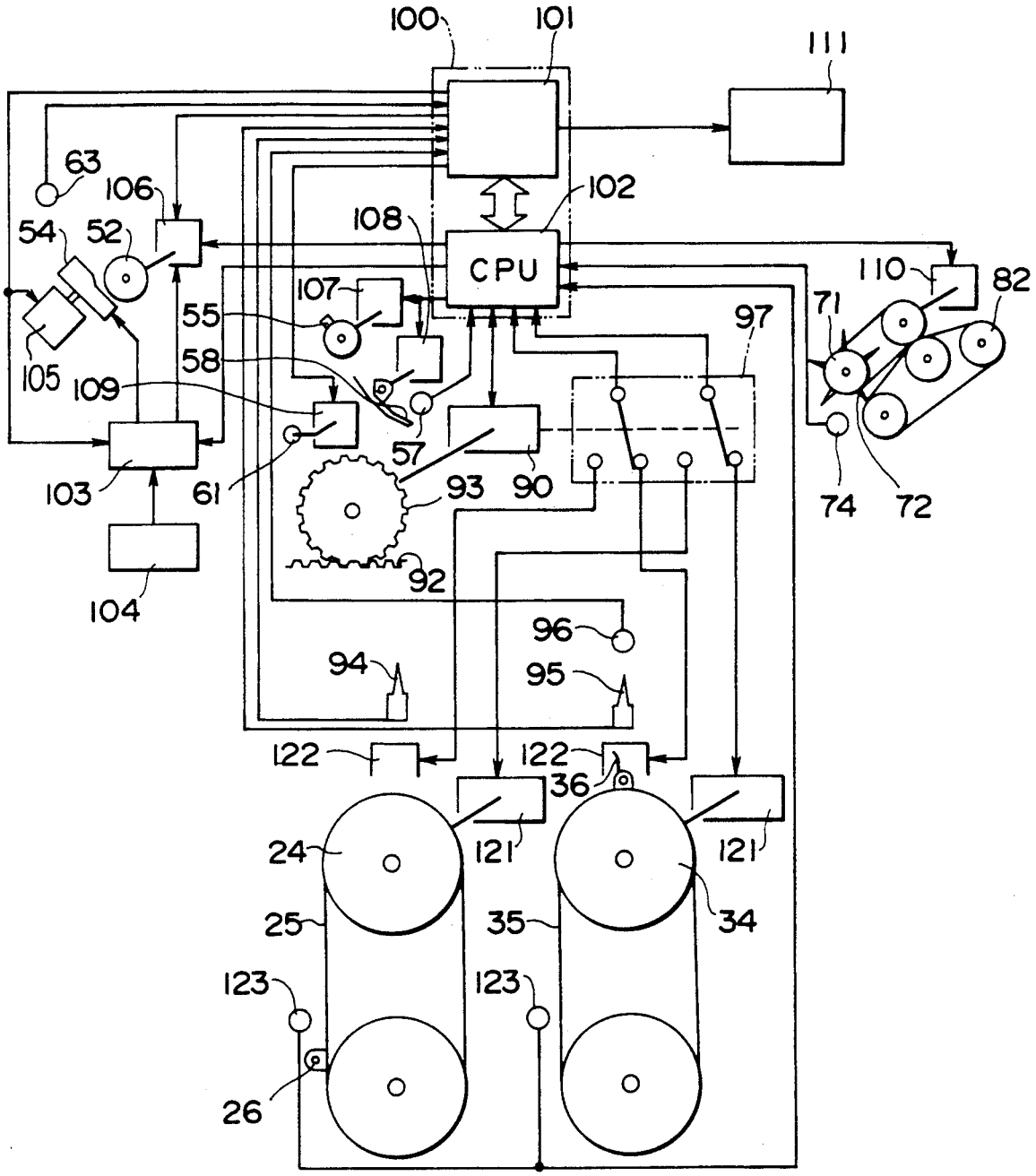
FIG. 8 is a circuit diagram showing the control system of the device.

As shown in FIG. 8, control device 100 includes control board 101 to which detection signals from various sensors are input, and central processing unit (CPU) 102 for outputting control signals in preset controlling modes based on the signals input from the control board 101.

A detection signal from sensor 63 provided in original printing stencil supplying device 5 is input to control board 101. Platen driving device 106 starts to rotate platen 52 to supply the stencil paper or stop it when the signals from control board 101 and CPU 102 are input. Thermal head moving device 105 receives the image writing signals from control board 101 and then moves thermal head 54 toward platen 52. Imaging device 104 which is, for example an image reading device or a word processor, outputs image signals of the image to be printed. Image writing device 103 feeds the image signals from the imaging device 104 to thermal head 54, when the image writing signal from control board 101 is input to image writing device 103. Image writing device 103 feeds a control signal to platen driving device 106 to synchronize the operation for forming an image on the stencil paper with thermal head 54 and the operation for supplying stencil paper 50 to platen 52.

CPU 102 outputs control signals to driving device 109 of spreading roller 61, driving device 107 of rotary cutter 55 and hopper outlet opening/closing device 108 for opening/closing rotary plate 58 at the outlet of guide 56. Further, CPU 102 outputs a control signal, for controlling the starting/stopping of roller 71, to used printing stencil take- up roller driving device 110. Used printing stencil 70 is moved from each of screens 25 and 35 of printing device 2 into used printing stencil collecting device 7, and a detection signal from sensor 74 for assuring that the rear end thereof is received into used printing stencil receiving device 80 is input to CPU 102. Also, a detection signal from sensor 57 for detecting the front end of the original printing stencil which is fed from original printing stencil supplying device 5 to each of screens 25 and 35 of printing device 2 at the outlet of original printing stencil supplying device 5, is input to CPU 102. Further, pinion 93 of moving device 9 is driven by means of driving device 90. Pinion driving device 90 is also controlled by a signal from CPU 102.

Opening/closing devices 122 for clamps 26 and 36 of printing device 2 are respectively positioned near cylinders 24 and 34, and opening/closing devices 122 open/close clamps 26 and 36 which pass the positions in which they are positioned. Cylinders 24 and 34 are driven by respective cylinder driving devices 121. CPU 102 outputs control signals to opening/closing devices 122 for clamps 26 and 36 and cylinder driving devices 121 via cylinder selector 97. Cylinder selector 97 selectively connects opening/closing device 122 and driving device 121 for cylinder 24 or 34 to CPU 102. Sensor 123 is positioned in an area through which screens 25 and 35 pass, detects an original printing stencil alignment mark and outputs a detection signal to CPU 102.

Multi-color printing controlling circuit 111 is of substantially the same construction as circuits of prior art apparatus and starts the operation in response to a print starting signal from control board 101.

Now, the operation of the device of this invention is explained, referring to FIGS. 4 through 7. First, new original printing sheet 33 is supplied onto screen 35 mounted on cylinders 31 and 34 of printing device 2 and used printing stencil 70 on the screen 35 is discharged and collected. After the printing operation in a preceding cycle using screen 35 is completed, original printing stencil supplying device 5 and used printing sheet collecting device 7 are moved to an area directly above cylinder 34 as shown in FIGS. 1 through 7.

Original printing stencil supplying device 5 is first activated by control board 101. As a result, thermal head 54 is separated from platen 52, rotary cutter 55 is set in the stand-by state in the starting position, spreading roller 61 is set in a position (indicated by a broken line **61*a* in FIGS. 4 through 7) where roller 61 is separated from cylinders 24 and 34, and rotary plate 58 of guide 56 is set in the stand-by state in the open position. After roll master 51 is set, stencil paper 50 is supplied from roll master 51 and the front end portion thereof is inserted between platen 52 and thermal head 54. Platen 52 is rotated by operating platen driving device 106 using control board 101, thus feeding stencil paper 50 in small amounts. One of the pressure transferring sections (screen 25 or 35) which is used to supply an original printing stencil and collect a used printing stencil is selected using control board 101. In this example, the pressure transferring section having screen 35 is selected. As a result, pinion driving device 90 drives pinion 93 in a forward or reverse direction until sensor 96 is exactly aligned with index 95. Pinion driving device 90 stops the rotation of pinion 93 when sensor 96 is exactly aligned with index 95, and pinion 93 is fixed in this position by a suitable means. As a result, moving device 9 is fixed in exactly the preset position directly above cylinder 34 of the specified pressure transferring section (screen 35). Further, cylinder selector 97 is set on the side of the selected transferring section (screen 35), and a control signal from CPU 102 is supplied to clamping element opening/closing device 122 and driving device 121 of cylinder 34**.

CPU 102 outputs a control signal to cylinder driving device 121 to rotate cylinder 34 and stop clamp 36 mounted on screen 35 at a position on the upper end of cylinder 34. After this, CPU 102 drives clamping element opening/closing device 122 to open the clamping element of the clamp 36 on screen 35.

Figure 6:
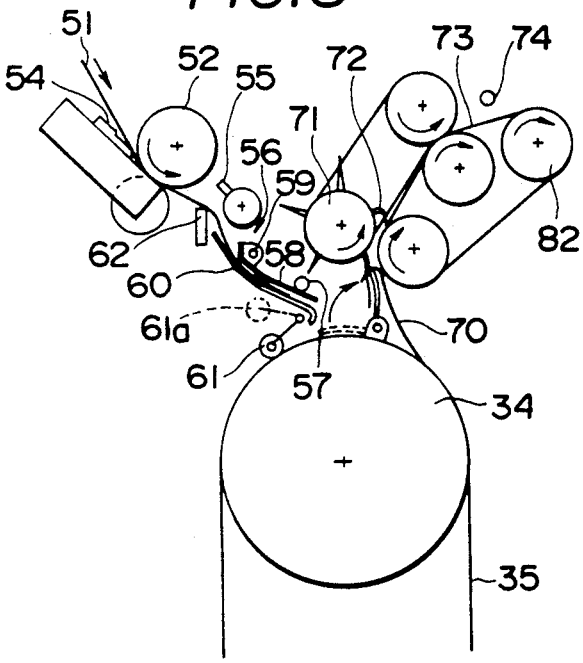
Figure 7:
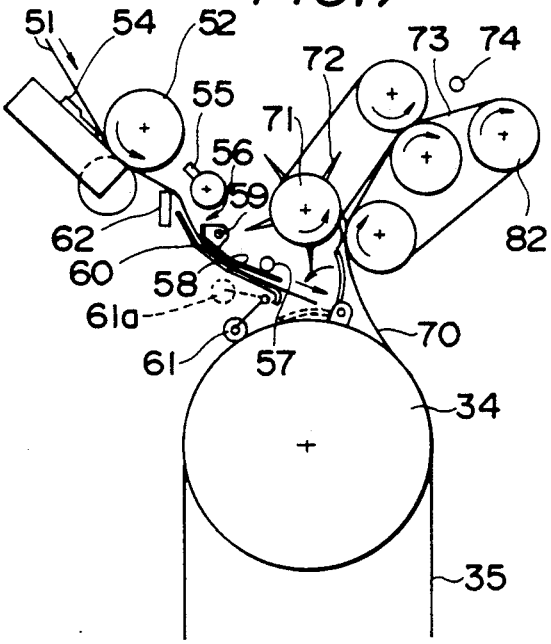

CPU 102 turns on the used printing stencil take-up roller driving device 110 so that used printing stencil 70 lying on screen 35 can be picked up by blades 72 of roller 71 and then collected by take-up core 81 of the used printing stencil collecting device 7 as shown in FIGS. 6 and 7. When sensor 74 has detected the rear end of the used printing stencil, CPU 102 outputs a control signal to the used printing stencil take-up roller driving device 110 to stop roller 71.

The stencil paper is supplied as follows. First, thermal head moving device 105 is operated in response to an original printing stencil supplying signal from control board 101 to set thermal head 54 in contact with stencil paper 50, thus holding stencil paper 50 between platen 52 and thermal head 54. Image writing device 103 outputs an alignment mark previously stored in CPU 102 to thermal head 54 so as to form the alignment mark on stencil paper 50.

At this time, spreading roller driving device 109 rotates roller 61 to a position in which it can roll on cylinder 34.

When an original printing stencil forming signal is supplied from control board 101 to image writing device 103, it synchronously drives thermal head 54 and driving device 106 of platen 52 so as to form an image on stencil paper 50 to create original printing stencil 33 by means of thermal head 54 based on an image signal from imaging device 104 such as an image reading device or a word processor.

Stencil paper 50 or stencil 33 is fed in a forward direction by platen 52 while an image is being etched on the stencil paper. When the front end of the stencil paper is detected by sensor 57, the detection signal is input to CPU 102, and CPU 102 starts to measure the rotation angle of platen 52, by use of a counter, based on the signal from driving device 106. Rotation angles of the platen corresponding to "length of one original printing sheet" and "gripping margin" of the clamping element of the clamp 36 are previously set as constants in CPU 102, and when the measured number has reached the constants, "length of one original printing sheet" and "gripping margin" signals are output. When the rear end of one original printing sheet is detected by sensor 57, the rear end detection signal is also input to CPU 102. When CPU 102 has received the rear end detection signal, it terminates the operation of measuring the count and resets the measuring counter to "0".

When the "gripping margin" signal is generated, CPU 102 drives the clamping element opening/closing device 122 to close the clamping element of clamp 36 and clamps the front end portion of a preset length of original printing stencil 33. At the same time, cylinder 34 is started to rotate by means of cylinder driving device 121 to feed stencil 33 along the surface of cylinder 34, mount stencil 33 with roller 61 which is set in contact with cylinder 34 at the time of generation of the stencil paper supplying signal, and mount stencil 33 on screen 35. At this time, the outer circumferential speed of cylinder 34 is synchronized with that of platen 52.

When the "length of one original printing stencil" signal is generated, the signal is supplied from CPU 102 to rotary cutter driving device 107 to drive cutter 55 to cut stencil paper 50. At the same time, the signal is supplied to hopper outlet opening/closing device 108 so that the outlet of guide 56 may be closed by means of rotary plate 58 and stencil paper 50 is held between rotary plate 58 and fixed plate 60. The output signal is also supplied to cylinder driving device 121. Driving device 121 rotates cylinder 34 in response to the "length of one original printing stencil" signal at a preset speed which is not synchronized with the operation speed of platen 52. Rotation of cylinder 34 causes screen 35 to move, and original printing sheet 33 is mounted on screen 35 by means of roller 61. When sensor 123 detects the alignment mark made on original printing sheet 33, CPU 102 outputs a control signal to driving device 121 to stop cylinder 34. At the same time, the stop signal for cylinder 34 from sensor 123 has a function of activating all the functions of original printing stencil supplying device 5, used printing stencil collecting device 7 and moving device 9.

After the above process is completed, CPU 102 operates moving device 9 to move original printing stencil supplying device 5 and used printing stencil collecting device 7 onto cylinder 24 of the other pressure transferring section, and repeats the operation as described above.

After all the original printing sheets are mounted, a printing starting signal is supplied from control board 101 to the multi-printing control circuit 111 so as to effect the multi-printing operation. In this way, the original printing stencil supplying device and used printing stencil collecting device can be selectively moved as an integral unit between the pressure transferring sections, and therefore, unlike other machines, the operation of manually mounting the original printing stencils while aligning the original printing stencils to the pressure transferring sections arranged for respective colors can be omitted and the troublesome operation of correcting the position deviation of images for respective colors each time the trial printing operation is conducted can be eliminated. The number of trial printing operations can be significantly reduced and the alignment technique does not require much skill so a more inexpensive stencil rotary press operation can be attained.

The above operation can be attained by this invention in which creation, supply and mounting of the original printing stencils can be successively and automatically made by the same device and in the same procedure with high accuracy. A method for printing the contents of an original printing stencil uniformly used as a frame or background, and other original printing stencils whose content is changed can be easily and efficiently done with this invention.

Further, since it is not necessary to touch the used printing sheet, the operation can always be accomplished cleanly; and unused stencil paper, original printing stencils and printing paper can be protected from being inadvertently stained.

In this invention, the operation of supplying the original printing stencil from original printing stencil supplying device 5 to printing device 2 can be made at the same time the operation of discharging the used printing stencil from printing device 2 to used printing stencil collecting device 7 is made, or the above operations can be alternately made with a time delay.

What is claimed is:

1. A multi-color printing apparatus comprising:

a plurality of pressure transferring means provided for respective colors, each of which presses printing paper against an original printing stencil to transfer the image thereto;

printing paper supplying means for passing printing paper through the plurality of pressure transferring means;

an original printing stencil supplying device having a stencil supplying section for supplying stencil paper, a thermal head for engraving an image on the stencil paper and a cutter for cutting the engraved stencil paper at a preset length to provide original printing stencils, the original printing stencil supplying device supplying an original printing stencil to the pressure transferring means;

a used printing stencil collecting device for collecting used printing stencils discharged from the pressure transferring means; and moving means for moving the original printing stencil supplying device and used printing stencil collecting device at the same time as an integral unit between the pressure transferring means, to selectively set the original printing stencil supplying device and used printing stencil collecting device to the position of one of the pressure transferring means.

2. A multi-color printing apparatus according to claim 1, wherein each of the pressure transferring means includes a first cylinder, a second cylinder positioned on a printing paper transferring side, a loop screen positioned to pass over the first and second cylinders, and a clamp mounted on the screen to clamp the front end of the original printing stencil.

3. A multi-color printing apparatus according to claim 2, wherein the pressure transferring means includes multiple rollers and a loop conveyer belt to pass over the rollers, the conveyer belt being in contact with the second cylinder of the pressure transferring means.

4. A multi-color printing apparatus according to claim 3, wherein some of the rollers of the pressure transferring means are pressure rollers arranged with the conveyer belt positioned between the pressure rollers and the second cylinder.

5. A multi-color printing apparatus according to claim 4, wherein the printing paper supplying means supplies unprinted paper between the conveyer belt and the second cylinder arranged on an upstream side with respect to the moving direction of the conveyer belt and takes out and collects the paper, which has been printed, from between the conveyer belt and the second cylinder arranged on a downstream side.

6. A multi-color printing apparatus according to claim 5, wherein the conveyer belt has air-permeability, and the pressure transferring means has suction means positioned in the moving path of the conveyer belt, the printing paper being drawn by the suction means via the conveyer belt and adhered to the conveyer belt.

7. A multi-color printing apparatus according to claim 2, comprising an inking device for supplying ink of preset color to the original printing stencil mounted on the screen of the pressure transferring means.

8. A multi-color printing apparatus according to claim 7, wherein the position in which the original printing stencil is supplied from the original printing supplying device to the pressure transferring means is set in substantially the same position in which one of said used printing stencils is discharged from the pressure transferring means to the used printing stencil collecting device, and the moving means sets the original printing stencil supplying device and the used printing stencil collecting device to one of the first cylinders of the pressure transferring means.

9. A multi-color printing apparatus according to claim 8, wherein the used printing stencil collecting device includes a take-up core for taking up said one of said used printing stencils, and guiding means having a plurality of rollers and belts positioned to pass over the rollers, the guiding means guiding said one of said used printing stencils to the take-up core.

* * * * *